United States Patent [19]

Arnell

[11] Patent Number: 4,702,436

[45] Date of Patent: Oct. 27, 1987

[54] PROJECTILE GUIDE MECHANISM

[75] Inventor: Anders Arnell, Eskilstuna, Sweden

[73] Assignee: Affarsverket FFV, Eskilstuna, Sweden

[21] Appl. No.: 890,148

[22] PCT Filed: Nov. 25, 1985

[86] PCT No.: PCT/SE85/00483

§ 371 Date: Jul. 24, 1986

§ 102(e) Date: Jul. 24, 1986

[87] PCT Pub. No.: WO86/03579

PCT Pub. Date: Jun. 19, 1986

[30] Foreign Application Priority Data

Dec. 13, 1984 [SE] Sweden ..... 8406351

[51] Int. Cl.[4] ..... F42B 13/32

[52] U.S. Cl. ..... 244/328; 244/3.26

[58] Field of Search ..... 244/3.26–3.3

[56] References Cited

U.S. PATENT DOCUMENTS

| | | | |
|---|---|---|---|
| 2,821,924 | 2/1958 | Hansen et al. | 244/3.28 |
| 3,053,184 | 9/1962 | Francois | 244/3.28 |
| 3,086,467 | 4/1963 | Gallagher et al. | 244/3.26 |
| 3,098,446 | 7/1963 | Jasse | 244/3.28 |
| 3,196,793 | 7/1965 | Milenkovic et al. | 244/328 |
| 3,289,587 | 12/1966 | Donnelly et al. | 244/3.28 |
| 3,944,168 | 3/1976 | Bizien et al. | 244/3.28 |

FOREIGN PATENT DOCUMENTS

| | | | |
|---|---|---|---|
| 960882 | 3/1957 | Fed. Rep. of Germany . | |
| 609620 | 9/1956 | Netherlands | 244/3.28 |

*Primary Examiner*—Charles T. Jordan
*Assistant Examiner*—Michael J. Carone
*Attorney, Agent, or Firm*—Fleit, Jacobson, Cohn & Price

[57] ABSTRACT

A guide mechanism for a projectile (2) which is intended to be fired from a barrel (3) with the aid of propellant gases. The projectile comprises a plurality of elongated fins (5) which are journalled at one end thereof and which are arranged to occupy a folded position during passage of the projectile through the barrel. The fins are subjected to a fin-extending force with the aid of a piston (7) which is arranged for movement in a housing (6) in the guide mechanism. The guide mechanism also incorporates a channel means (10) through which during a pressure increase phase of the propellant gases in the barrel the gases are passed to a chamber (9) located on one side of the piston and build-up a piston working pressure (p) in said chamber. The channel means (10) has arranged therein a valve (11) which is operative in throttling the channel means during a pressure reduction phase of the propellant gases. This pressure reduction phase can be dimensioned to commence before the guide mechanism reaches the muzzle of the barrel.

6 Claims, 2 Drawing Figures

PROJECTILE GUIDE MECHANISM

TECHNICAL FIELD

The present invention relates to a guide mechanism for projectiles of the kind which are fired from a barrel with the aid of a propellant charge, the guide mechanism including a plurality of elongated fins which are journalled at one end thereof and which are held in a folded position during passage of the projectile through the barrel and are arranged to be extended by means of a finextending force delivered by a piston arranged for movement in a guide-mechanism housing while in dogging engagement with the fins, and which mechanism further comprises channel means through which propellant gases are delivered to a chamber located on one side of the piston during a pressure increase phase of the propellant gases in the barrel.

BACKGROUND PRIOR ART

Guide mechanisms of the aforesaid kind are known to the art from, for example, German Patent Specification DE No. 960 882. It has been found, however, that with this known mechanism the fins are often extended much too slowly, resulting in insufficient muzzle stability of the projectile. The tail of the projectile is namely still influenced by the pressure exerted by the propellant gases (powder gases) even when the guide surfaces of the projectile have left the muzzle of the barrel, and uneven loads on the fins can therewith cause pronounced wobble or yaw of the projectile in the vicinity of said muzzle, resulting in impaired external ballistics and impaired precision. This problem is particularly difficult to overcome in the case of dart shaped or sweepback projectiles.

DISCLOSURE OF THE INVENTION

Consequently, the object of the invention is to provide a guide mechanism of the aforementioned kind with which the fins are extended more rapidly than with guide mechanisms known hitherto. The invention relates particularly, but not exclusively, to the provision of such a guide mechanism in which the fin-extending force is able to act on the fins before the projectile has reached the nozzle of the barrel, thereby enabling the fins to stabilize the projectile during the actual passage of the projectile through the barrel.

This object is achieved with a guide mechanism constructed in accordance with the invention and having the characteristic features set forth in the characterizing clause of claim 1.

Further developments of the invention are disclosed in the depending claims.

As a result of throttling the channel means in the guide mechanism during the pressure reduction stage, the level of the working pressure is increased and the time taken to evacuate the chamber prolonged. This causes the fins to be extended much more quickly than was previously the case, and makes possible, inter alia, the aforesaid early fin-stabilization of the projectile during its passage through the barrel.

This latter possibility of particular importance when firing with modern lightweight barrels constructed in accordance with wound-glassfibre techniques. Such firing barrels have a large radial stretch, i.e. large clearance, and hence poor precision can be expected. This problem can now be solved in accordance with the invention due to the fact that when necessary (primarily, but not exclusively, in the case of dart-like projectiles) the fins can be caused to extend outwardly prior to the guide mechanism reaching the muzzle of the barrel. The fins are thereby urged against the barrel wall and stabilize the rear part of the projectile during its travel through the barrel.

BRIEF DESCRIPTION OF THE DRAWING

The invention will now be described in more detail with reference to the accompanying drawing, which schematically illustrates a preferred embodiment of the invention.

FIG. 1 illustrates the guide mechanism during the pressure increase phase, whereas

DESCRIPTION OF A PREFERRED EMBODIMENT

Figure 1:
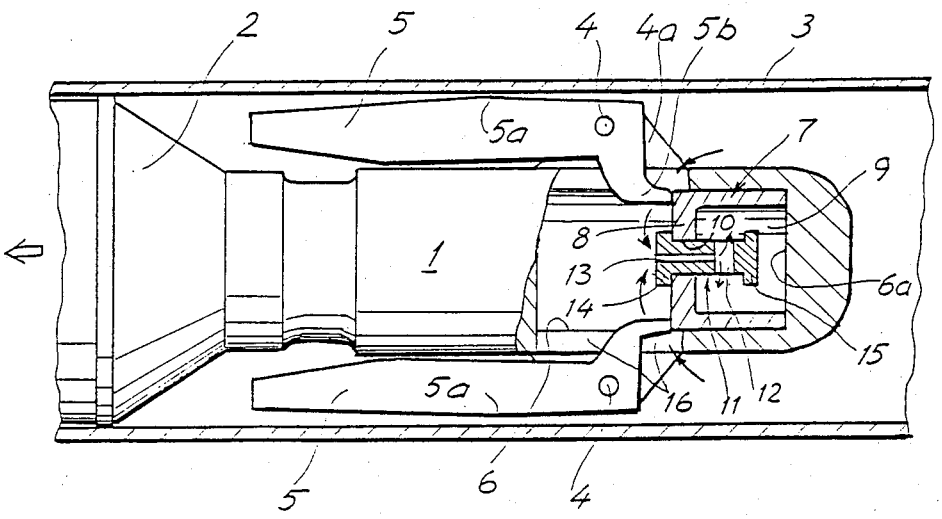

FIG. 1 illustrates the rear section 1 of a projectile 2, for example a conventional dart-shaped or sweepback projectile. The projectile 2 is mounted in a conventional manner in a cartridge or shell (not shown) intended for insertion to a loaded position in the preferably rifled barrel 3 of a weapon (not shown in detail), for example an anti-tank rifle. The rear section 1 of the projectile is provided with a guiding and stabilizing mechanism in the form of a plurality of elongated fins 5 which are journalled at one end thereof on a respective journal 4 and which, together with the rear section 1 of the projectile, are arranged to be encased in the cartridge or shell, with the fins 5 lying loosely against the rear section 1, in the absence of separate securing devices. The fins 5 remain in their folded state during passage of the projectile through the barrel. The journals 4 are fitted to flanges or lips **4*a* projecting outwardly from the rear section 1 of the projectile 2. Each of the fins 5 presents a knee 5*a* which is intended to be held pressed against the wall of the barrel 3 during a pressure reduction phase of the propellant gases. The knee 5*a* reduces the length of the lever arm of the fin-extending force, to the distance between the knee 5*a* and the associated journal 4. Each fin 5 also has arranged in its rearward end a shoulder 5*b***, the function of which will be described hereinafter.

The rear section 1 of the projectile 2 has formed therein a recess 6 which forms a housing in which a sleeve-shaped piston 7 is arranged for movement in the direction of the longitudinal axis of the projectile. The rear end of the piston, as seen in the firing direction of the projectile (marked by the arrow on the far left of the Figures), is fully open, whereas the forward end of the piston 7 is closed by a wall 8. The interior of the sleeve-shaped piston 7 therewith forms a chamber 9 in which a piston-working pressure p is able to act on the rear wall of the recess or cavity 6.

The wall 8 has provided therein a throughpassing aperture 10, hereinafter referred to as the channel means, in which a valve in the form of a plunger 11 can move in the direction of the longitudinal axis of the projectile. Arranged in the rear part of the valve 11 is a radial or transverse channel 12 which joins at its centre a channel 13 which extends in the direction of the longitudinal axis of the valve 11 and departs from the forward end thereof. Axial movement of the valve 11 is limited by stop heads 14 and 15 located on a respective end of the valve.

In the inactive position, the shoulder 5*b* of the respective fins abuts the wall 8 of the piston 7, so that a fin-extending force can be exerted on the fins when the piston is caused to move forwards from the position shown in FIG. 1.

The recess 6 is provided with elongated openings 16 for accommodating the shoulders 5*b* of respective fins 5, so that the shoulders are able to move as the fins are extended.

The projectile is arranged to be fired from a cartridge or shell, not shown, in a conventional manner, with the aid of a propellant in the form of a powder charge. FIG. 1 illustrates the position in which the projectile 2 has left the cartridge and commenced its passage through the barrel 1. In this stage the fins are still folded-in against the rear of section 1 of the projectile. The valve 11 is pressed rearwardly as a result of the acceleration of the projectile, until the stop head 14 is pressed against the wall 8 of the piston 7, as illustrated in FIG. 1. Propellant gases deriving from the propellant charge therewith penetrate through the openings 16 (c.f. the arrows in FIG. 1) and enter the space in the housing 6 in front of the valve 7, from where they pass through the channels 13 and 12 to the piston chamber 9, where the pressure p of the bases is built-up. This takes place during a pressure increase phase of the propellant gases. Then the pressure of the propellant gases begins to decrease, i.e. the so-called pressure reduction phase, which according to the invention should be arranged to take place before the fins have reached the muzzle of the barrel 3, the gas pressure in the recess 6 forwardly of the piston 7 begins to decrease, due to the diminishing pressure of the propellant gases. Consequently, the valve 11 is moved forward under the influence of the working pressure p in the chamber 9, to the position shown in FIG. 2, where the radial channel is blocked by the walls of the channel means 10 in the wall 8. The channel means 10 is now throttled, i.e. the valve 11 occupies a closed position. The time taken to close the valve 11 is determined by the acceleration of the projectile, by the diameter of the aperture 10, and by the pressure p in the chamber 9. The pressure p is determined, in turn, by the gas pressure generated by the powder charge, the diameter of the channel 13, and the volume of the chamber 9. The valve closing time can thus be chosen within relatively wide limits.

Figure 2:
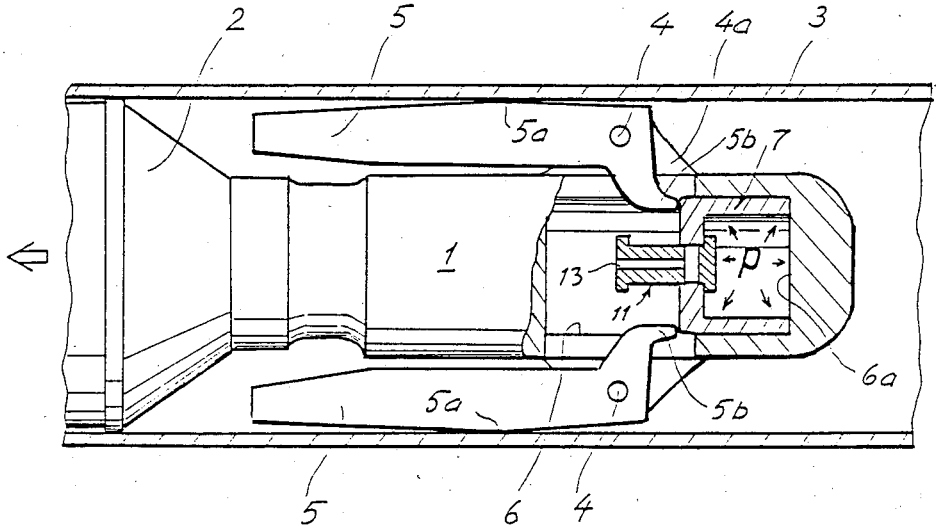
FIG. 2 illustrates the guide mechanism during the pressure reduction phase.

When the valve 11 closes due to a decrease in pressure in front of the piston 7, the piston will thus strive to move forward, i.e. to the left in FIG. 2, under the influence of the working pressure p, and therewith press against the shoulders 5*b* of respective fins and brings a fin-extending force to bear thereon. The fins 5 are therewith urged against the wall of the barrel 3 through the agency of the knees 5*a* of respective fins, so as to achieve the desired guidance of the rear section of the projectile during its passage through the barrel. As soon as the fins have reached the muzzle of the barrel, the fins are opened out to a fully extended position, and can be locked firmly in this position in a conventional manner, e.g. by wedging the fins with wedging means in accordance with Swedish Patent Specification SE No. 154 665.

Although the aforementioned dimensional parameters are preferably selected so that the fins are subjected to a fin-extending force prior to the fins reaching the muzzle of the barrel, these dimensional parameters may alternatively be selected so that outward extension of the fins commences at the same time as the fins reach the muzzle. Due to the fact that the valve 11 prevents gas from leaking from the piston chamber 9, a maximum piston pressure is attained for extension of the fins, and hence the fins will be extended much more quickly than with known guide mechanisms. Tests have shown that when using a guide mechanism according to the invention, the fins are fully extended within a distance of only one meter after leaving the muzzle of the barrel, at a projectile velocity of about 300 m/s.

The structural components of the guide mechanism can be varied in many ways. The valve 11 may, for example, have the form of a conventional non-return valve. Furthermore, the wall 8 of the piston 7 may be imperforate and the channel means 10 arranged in the wall of the housing 6 instead.

I claim:

1. A guide mechanism for a projectile (2) which is intended to be fired from a barrel (3) with the aid of propellant gases, comprising a plurality of elongated fins (5) which are journalled at one end thereof and which are arranged to occupy a folded position during passage of the projectile through the barrel, and which fins are subjected to a fin-extending force with the aid of a piston (7) which is arranged for movement in a housing (6) in the guide mechanism while in dogging engagement with the fins, a valve (11) being mounted coaxially within the piston and slideably therein, the valve being operative as a result of initial setback forces on the projectile to open a channel means (10) in the valve, such that, during a pressure increase phase of the propellant gases in the barrel, said gases are passed through said channel means to a chamber (9) located on one side of the piston in order to build-up a piston working pressure in said chamber, the valve being operative in throttling the channel means as a result of a pressure reduction phase of the propellant gases.

2. A guide mechanism according to claim 1, characterized in that the housing (6) is provided with openings (16) through which, during the pressure increase phase, the propellant gases are also passed to a space located on the other side of the piston (7), and through which evacuation of said space commences during the pressure reduction phase.

3. A guide mechanism according to claim 1, characterized in that the pressure reduction phase is dimensioned to commence prior to the guide mechanism reaching the muzzle of the barrel, such that said fin extending force begins to act on the fins before the projectile has reached said muzzle.

4. A guide mechanism according to claim 3, characterized in that the fins (5) present a knee (5*a*) which when abutting the barrel wall (3) reduces a momentum arm of the fin-extending force.

5. A guide mechanism according to claim 1, characterized in that the piston (7) is movable in the firing direction of the projectile (2) under the influence of said working pressure.

6. A guide mechanism according to claim 1, characterized in that the fins (5) are provided with respective shoulders (5*b*) which co-act with the piston (7).

* * * * *